US009410362B1

(12) United States Patent
Champlin

(10) Patent No.: US 9,410,362 B1
(45) Date of Patent: Aug. 9, 2016

(54) THERMAL BREAK SYSTEM

(71) Applicant: Richard S Champlin, Granger, IN (US)

(72) Inventor: Richard S Champlin, Granger, IN (US)

( * ) Notice: Subject to any disclaimer, the term of this patent is extended or adjusted under 35 U.S.C. 154(b) by 0 days.

(21) Appl. No.: 14/601,360

(22) Filed: Jan. 21, 2015

(51) Int. Cl.

| | |
|---|---|
| ***E06B 3/26*** | (2006.01) |
| ***E06B 7/28*** | (2006.01) |
| ***E06B 1/04*** | (2006.01) |
| ***E06B 1/56*** | (2006.01) |

(52) U.S. Cl.
CPC ... *E06B 7/28* (2013.01); *E06B 1/04* (2013.01); *E06B 1/56* (2013.01)

(58) Field of Classification Search
CPC ..... E06B 1/04; E06B 1/56; E06B 7/28
USPC ..... 52/202, 203, DIG. 4, 717.01, 717.02; 49/62, 463–466
See application file for complete search history.

(56) References Cited

U.S. PATENT DOCUMENTS

| | | | | |
|---|---|---|---|---|
| 4,409,758 | A * | 10/1983 | Dickerson | E06B 3/28 160/231.2 |
| 8,863,440 | B1 * | 10/2014 | Champlin | F41H 5/013 52/1 |
| 2007/0199259 | A1 * | 8/2007 | Parsley | G08B 13/04 52/203 |
| 2009/0133342 | A1 * | 5/2009 | Copeland | E04B 9/003 52/202 |
| 2015/0184444 | A1 * | 7/2015 | Wexler | E06B 3/285 52/203 |
| 2015/0376938 | A1 * | 12/2015 | Pardue | E06B 3/28 52/202 |

* cited by examiner

*Primary Examiner* — William Gilbert
(74) *Attorney, Agent, or Firm* — Botkin & Hall, LLP

(57) ABSTRACT

A thermal window system is provided where a cap is placed over an existing window frame. A top groove and a bottom groove are attached, along with side stops. A thermal window pane has a sash that surrounds another window pane. The sash fits into the top and bottom groove and overlays the side stops. The sash is held tightly to the side stops using magnetic attraction.

20 Claims, 7 Drawing Sheets

THERMAL BREAK SYSTEM

BACKGROUND OF THE INVENTION

This present disclosure relates to retrofit window insulation systems, specifically windows that are added to existing windows and window frames. A significant amount of effort and attention are spent towards increasing the thermal insulating properties of existing windows, as that is a primary source of energy loss in a building. Existing technologies focus on the window pane (by increasing the number or thickness of panes, inert gas, and coatings), but completely neglect the frame. The frame in most office windows is made from aluminum, an excellent conductor of heat. An improved retrofit window solution is needed.

SUMMARY OF THE INVENTION

The present disclosure describes an additional layer of insulation that is placed over the existing frame before any retrofit window is installed. The layer has a significantly lower thermal conductivity as compared to the aluminum frame it covers. By covering up the existing window and frame, a higher insulation value can be assigned to the retrofit system with the cap as compared to the system without the cap.

BRIEF DESCRIPTION OF THE DRAWINGS

A preferred embodiment of this invention has been chosen wherein.

DESCRIPTION OF THE PREFERRED EMBODIMENT

Figure 1:
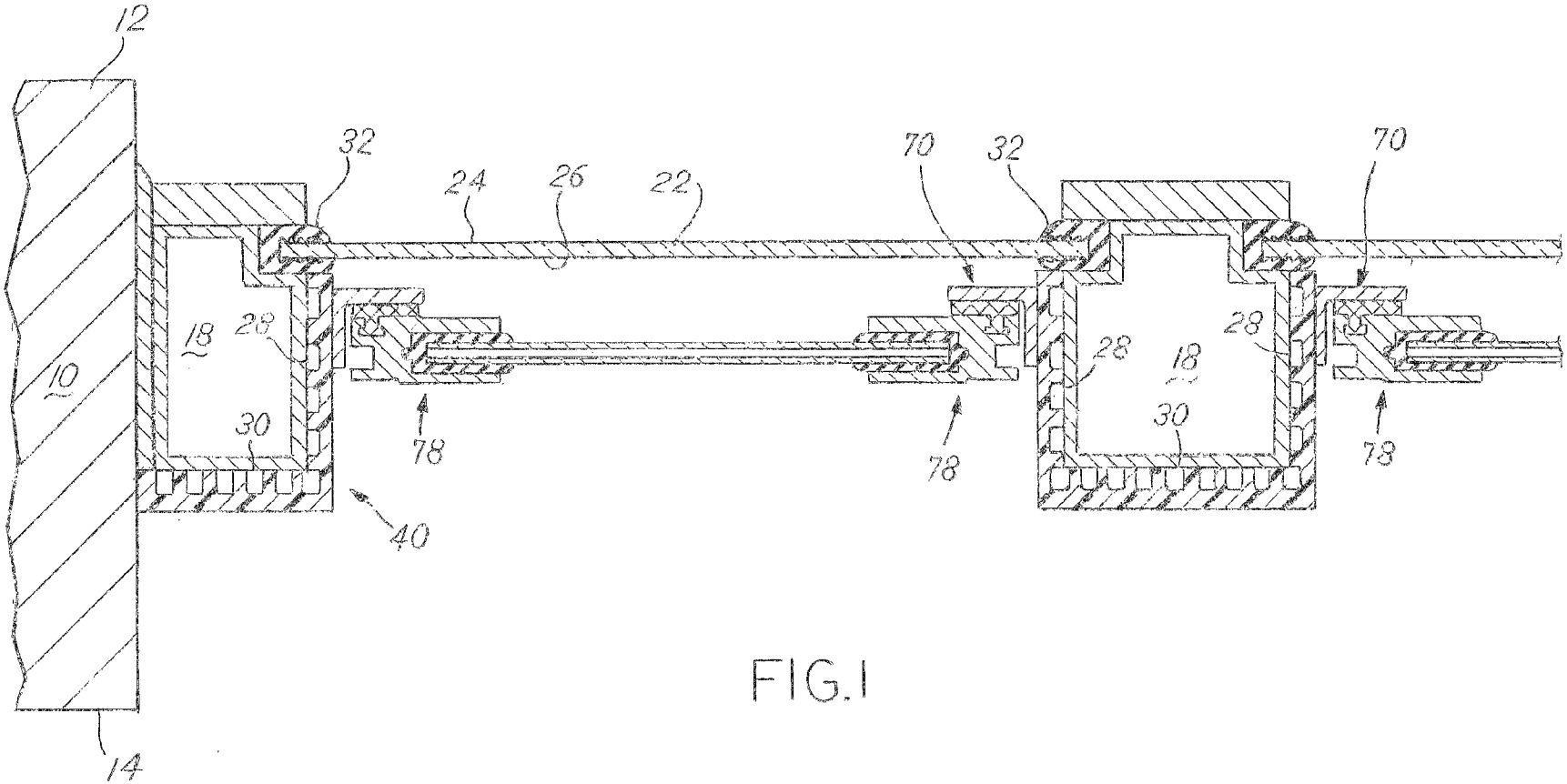
FIG. 1 is a horizontal section view of the thermal break system.
Figure 2:
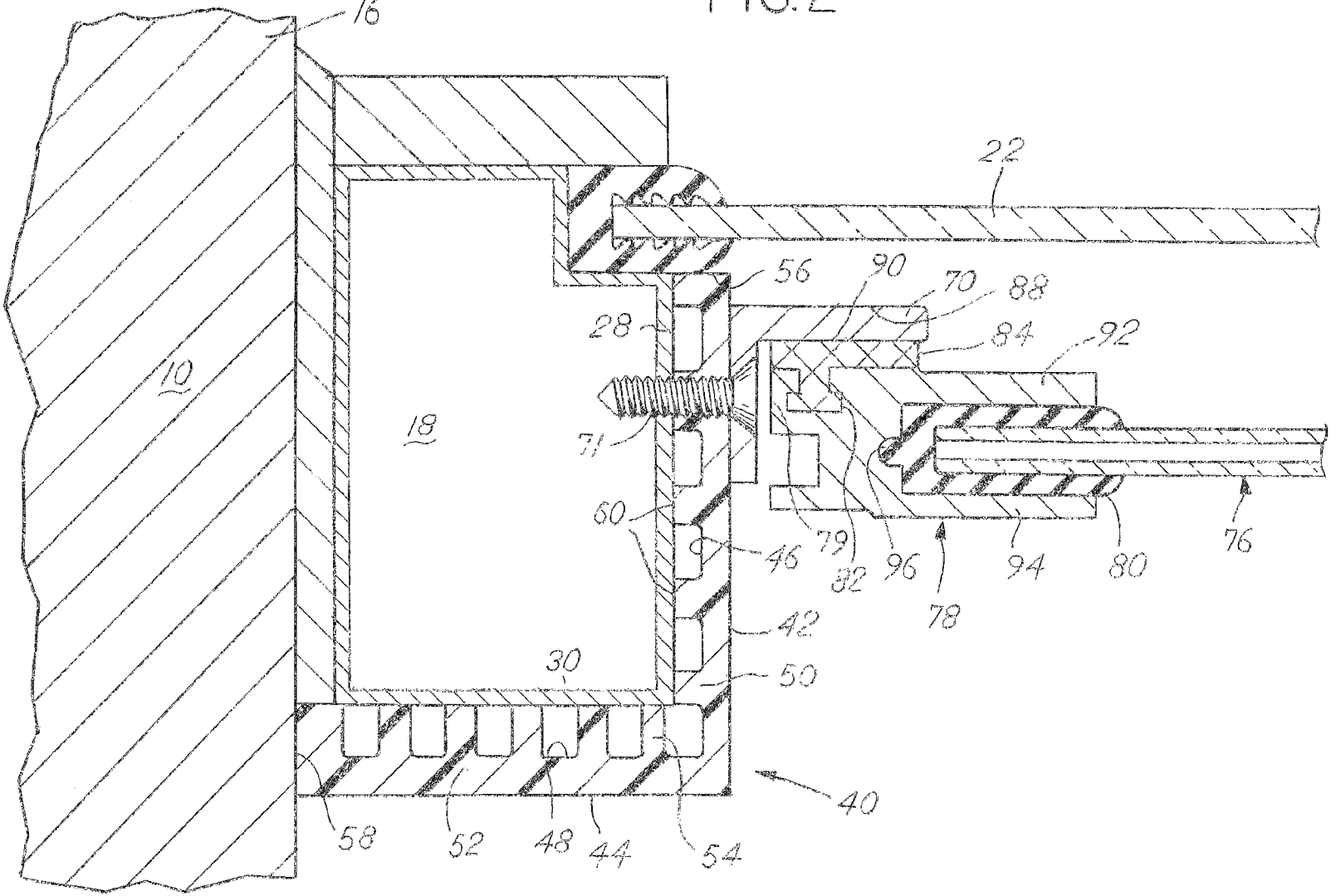
FIG. 2 is a partial view of the left side of the break system in FIG. 1.
Figure 3:
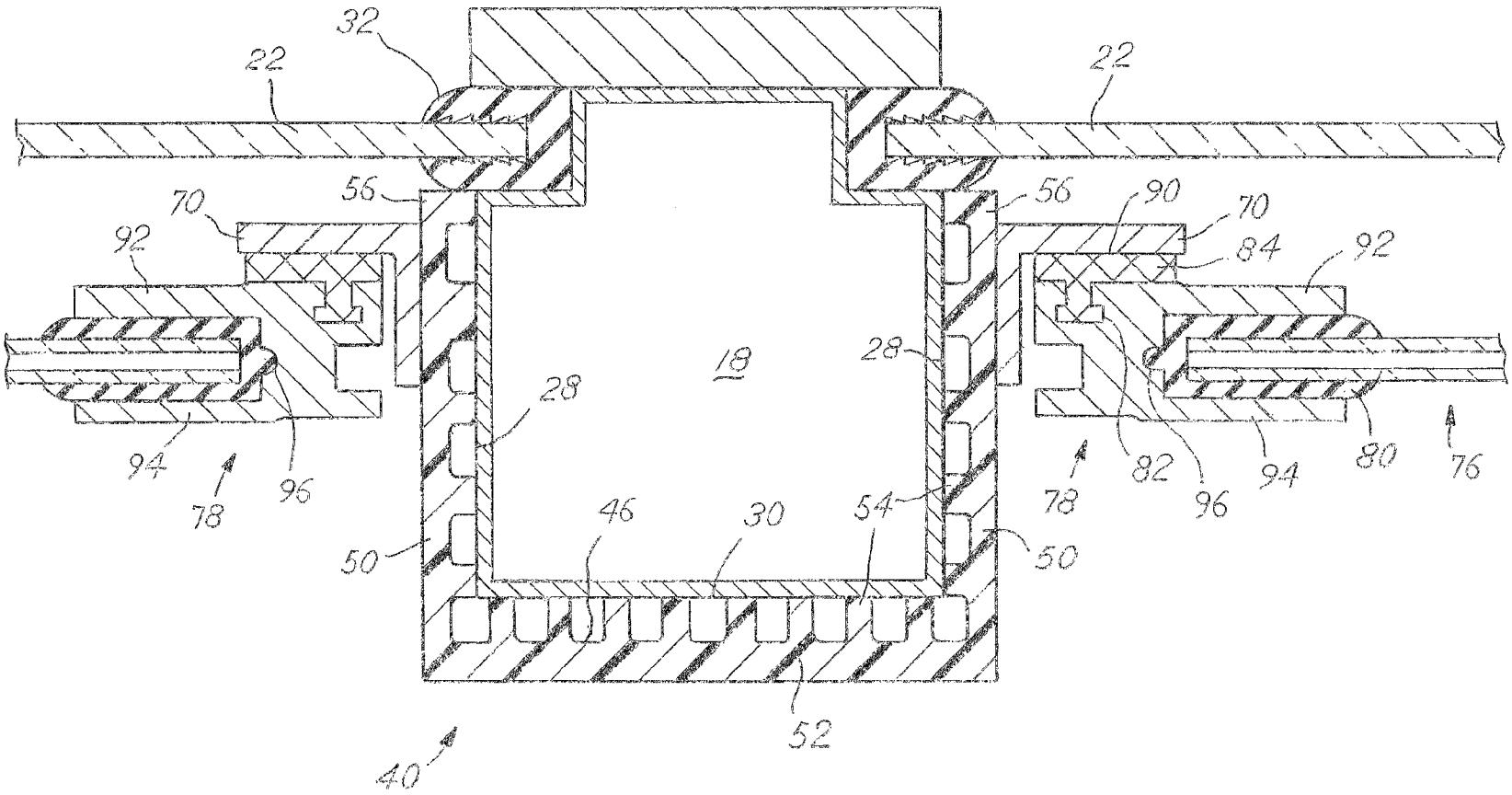
FIG. 3 is a partial view of the right side of the break system in FIG. 1.
Figure 4:
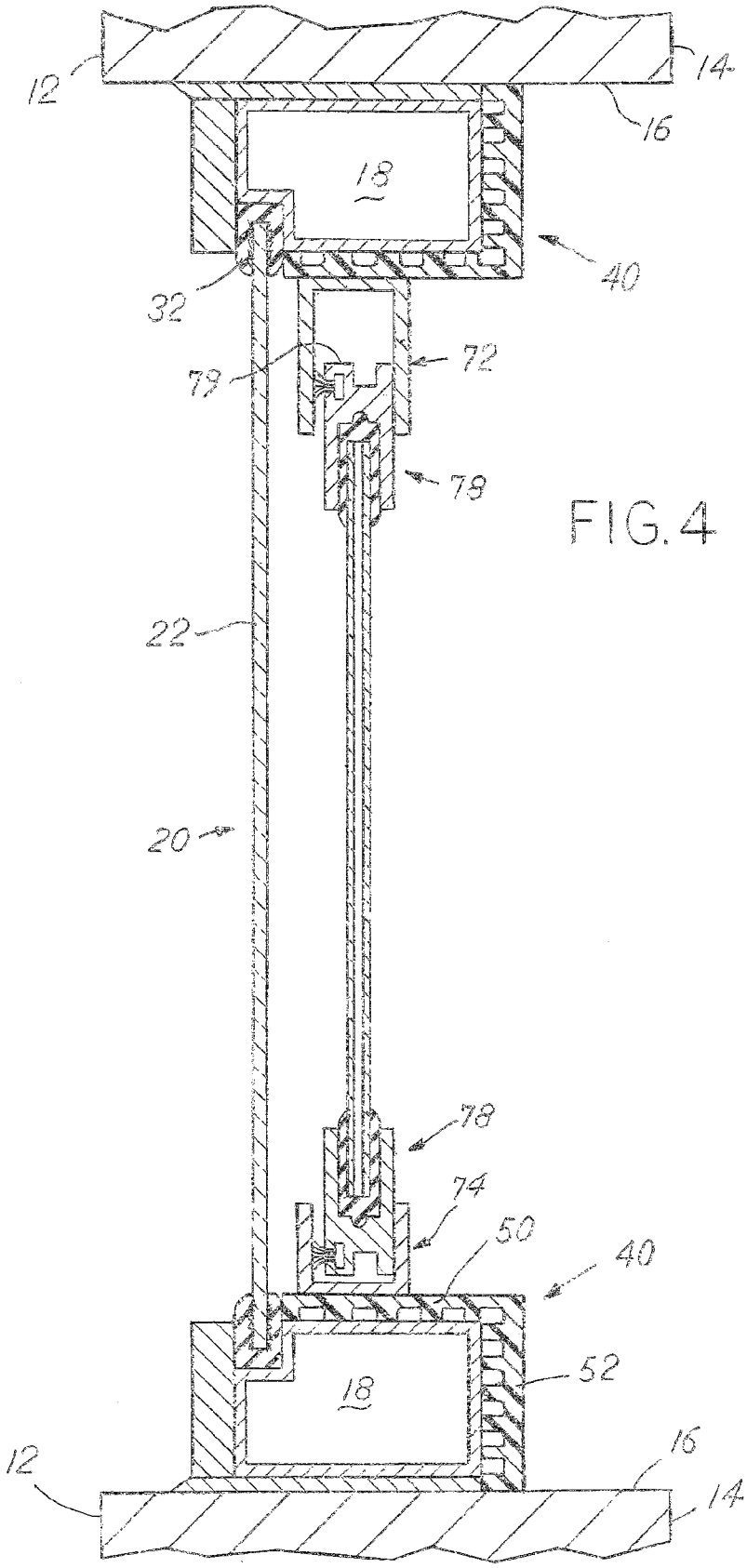
FIG. 4 is a vertical section view of the thermal break system.

A building wall 10 has an outside surface 12 and an inside surface 14 and an opening defined by a surface 16 FIG. 2 that connects the inside surface 14 to the outside surface 12. In the opening, an existing window 20 FIG. 4 is mounted, usually to the surface 16. The existing window 20 has an existing frame 18 which mounts an existing window pane 22 as shown in FIGS. 1, 2 and 3. The existing window pane 22 has an outside surface 24 and an inside surface 26. The existing window pane 22 is usually held to the existing frame 18 with a gasket 32 or adhesive. The existing frame 18 is usually sealed to the surface 16 as is commonly known in the art. The existing frame 18 has inside facing surfaces 28 and 30. This retrofit thermal break system is designed to mount on the inside of an existing window 20, specifically the frame 18. The existing frame 18 can also span between two adjacent existing windows 20 as is shown in FIG. 3.

The retrofit system has a cap 40 which is a single-piece wall. The cap 40 has a first portion 50 and a second portion 52. The first portion 50 intersects the second portion 52 at a slightly acute angle and is made from a material that has lower thermal conductivity than the frame 18. The cap 40 is made from a semi-rigid material which will allow it to flex slightly as installation requires. The cap 40 has exposed surfaces 42 and 44 on portions 50 and 52 FIG. 2 respectively. The cap 40 also has inner surfaces 46 and 48 and protrusions 54 that extend outward as shown in FIGS. 2 and 3. The protrusions 54 form a mating surface 60 FIG. 2. The protrusions 54 are intended to separate the cap 40 thermally from the existing frame 18 by trapping air between the inner surfaces 46, 48 and their corresponding exposed surfaces 28, 30. The cap 40 can have more than one first portion as is shown in FIGS. 1, 2 and 3. The protrusions 54 can form individual cavities or be separated. The cap 40 has lateral edges 56, 58 FIG. 2 at opposing terminal ends. The exposed surface 42 is designed to receive a mounting for the remainder of the components of the system as shown in all FIGS.

Figure 5:
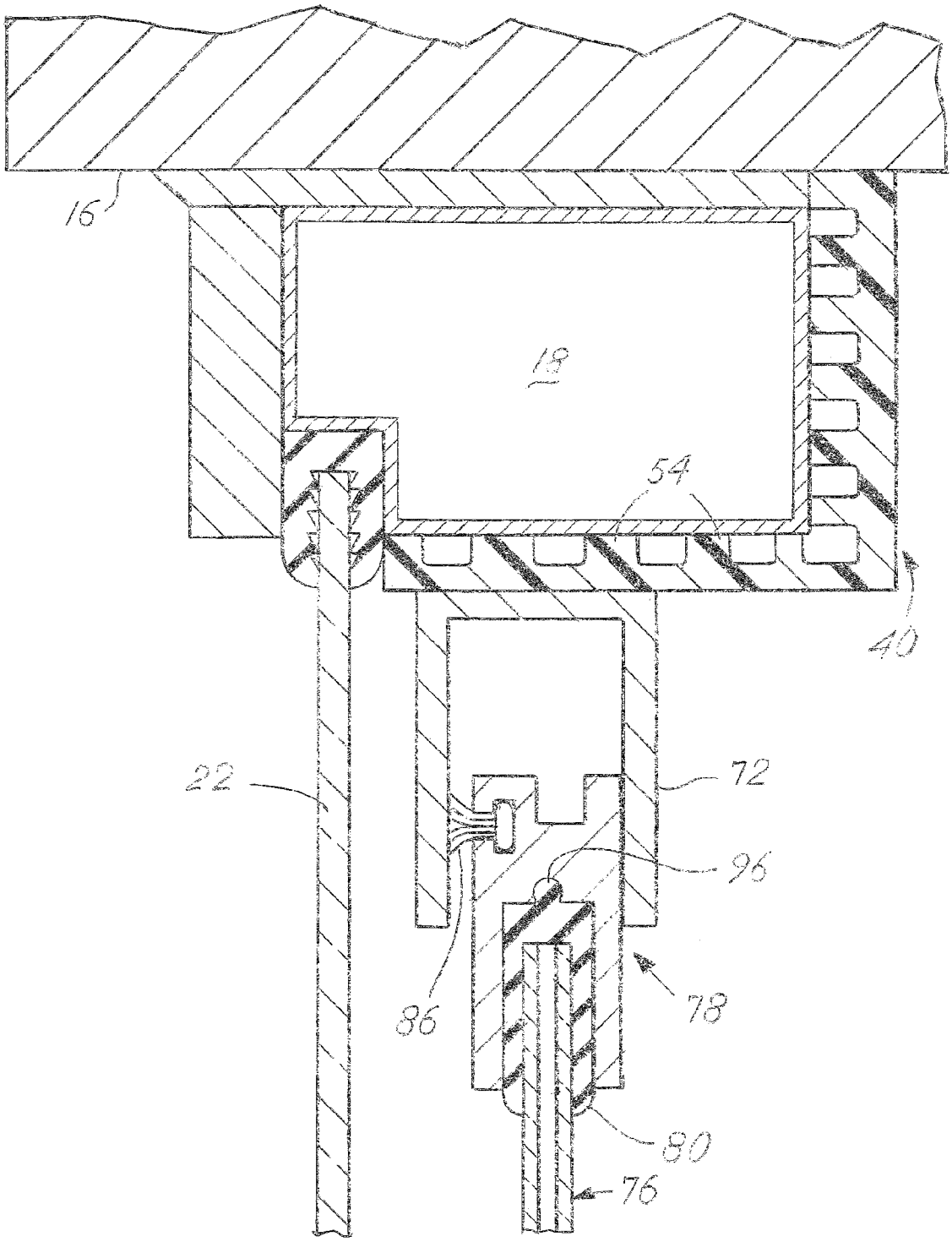
FIG. 5 is a partial view of the upper break system in FIG. 4.
Figure 6:
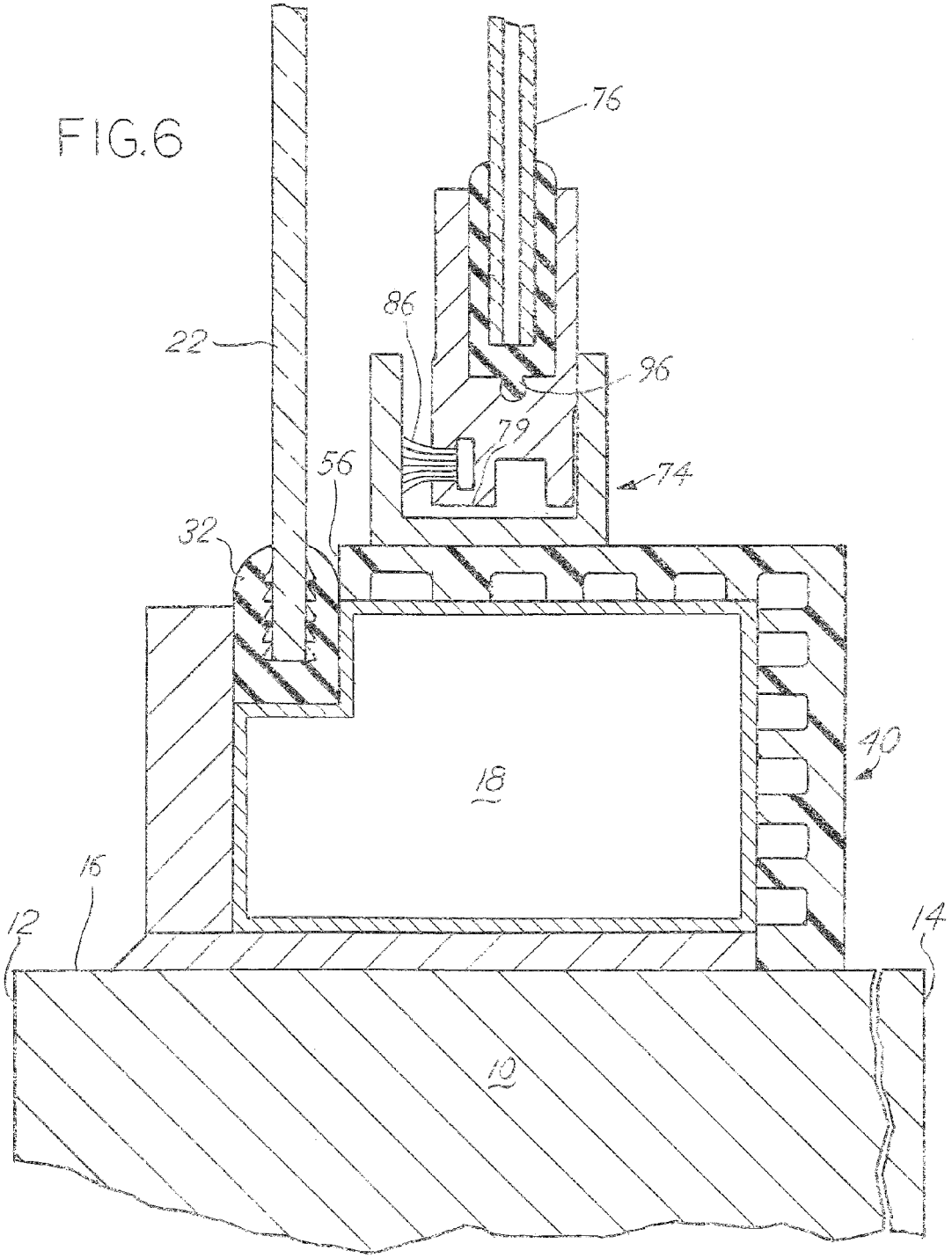
FIG. 6 is a partial view of the lower break system in FIG. 4.

A retrofit window system is also made up of a mounted portion and a removable panel. The mounted portion includes side rails 70, a top channel 72, and a bottom channel 74, FIG. 4. The cap 40, specifically the exposed surface 42, is adapted to receive the side rails 70, top channel 72, and bottom channel 74. These can be attached to the exposed surface 42 via screws 71 FIG. 2, adhesive, rivets, or other fastening means. The side rails 70 are steel or another metal that is attracted to a magnetic field. The top channel 72 is deeper than the bottom channel 74 to allow the panel clearance to be lifted up and be placed into the bottom channel 74, shown best on FIG. 4. The removable panel includes a window pane 76 and a sash 78 that encircles the window pane 76 FIG. 2. A gasket 80 secures the window pane 76 to the sash 78 and seals it. The sash 78 includes a channel 82 that holds a magnet 84 or a wool pile 86 FIGS. 5 and 6. As is shown in FIG. 2, the magnet 84 is located such that when the panel is installed, the outside facing surface 88 overlays the inside facing surface 90 of the side rail 70.

A panel with a sash 78 surrounds the perimeter of a window pane 76. Pane 76 is a window pane, such as formed from glass, plastic, or a composite, preferably formed from a material suitable for insulation. The pane 76 is typically a flat planar surface with a perimeter. The pane 76, as shown, is double-paned; other styles and number of panes are possible. The sash 78 as shown in all FIGS is formed from an aluminum extrusion with a groove formed from parallel upstanding walls 92, 94 FIG. 2 for receiving a window gasket 80. The interior surfaces of the upstanding walls 92, 94 may have ridges to retain the gasket 80. Between upstanding walls 92, 94, is a slot 96 for receiving a screw. Where sides of the sash 78 meet, the extrusion is cut at a 45° angle to form the mating surfaces of a corner. A hole is drilled in the adjacent/perpendicular sash member that is inline with the slot 96. The slot 96 is adapted to receive a self-tapping screw as is commonly known in the art. A screw (not shown) is inserted through the drilled hole and engages with the slot 96 to affix the adjacent sash members. The gasket 80 fits between upstanding walls 92, 94 and is adapted to receive window pane 76. It is possible that the pane 76 is secured to the sash 78 through adhesive, silicone, or other method instead of a gasket 80. As shown in FIGS. 1 and 2, a groove 82 in the exterior face of the sash 78 is adapted to receive a tongue of a magnet 84 or a wool pile 86. The magnet 84 overlies a portion of the exterior face of the sash 78, and is held to the sash 78 by the fit between the tongue and groove 82. In the embodiment as shown in FIGS. 1 through 3, the tongue is a protrusion and groove 82 is a channel that is adapted to receive the tongue. The magnet 84 or wool pile 86 is alternatively held to the sash 78 by adhesive, fasteners, or other means as are known in the art. The magnet 84 has an outward facing surface 88 and is charged to attract a ferromagnetic metal to the mating surface of side rail 70. On the top and bottom portions of the sash 78, instead of the magnet 84 in the groove, a wool pile 86 is installed. The wool pile 86 is designed to conform and distort as it mates up with another surface, thereby lowering the amount of air infiltration between the window pane and the adjacent channel 72, 74.

An exterior stop 70 as shown in FIGS. 1 through 3 is part of the system and is fastened to the sides of the existing frame 18 and thermal break cap 40. The exterior stop 70 serves to hold the sides of the sash 78 towards the exterior surface and limits the movement of the window panel in the exterior direction. The exterior stop 70 includes an exterior lip portion and a wall portion to form an L-shaped member. The lip portion and wall portion will be referred to hereinafter as lip and wall. The exterior stop 70 has an interior facing surface 88 as shown in FIG. 2. The exterior stop 70 is secured to the existing frame 18 and thermal break 40 by fasteners through the thermal break 40. As installed on the thermal break 40, the exterior lip extends perpendicularly therefrom. Exterior stop 70 is preferably formed from a ferromagnetic material, such as angle iron or stamped steel, to allow the magnet 84 to hold the sash 78 to the exterior stop 70. Optionally an adhesive tape or dispensed adhesive may be used between thermal break 40 and exterior stop 70 to hold it during installation prior to the fastener being installed through the wall to simplify installation of the system. Properly placed adhesive also prevents or reduces air infiltration. The window panel, specifically the distance between opposing surfaces of the perimeter 79, is smaller than the distance between opposing exterior stops 70 to compensate for size variations, sill irregularity, thermal expansion, and building movement. The gap formed between the perimeter 79 of the sash 78 and the exterior stop 70 is visible in FIG. 2, allowing for limited lateral movement.

Figure 7:
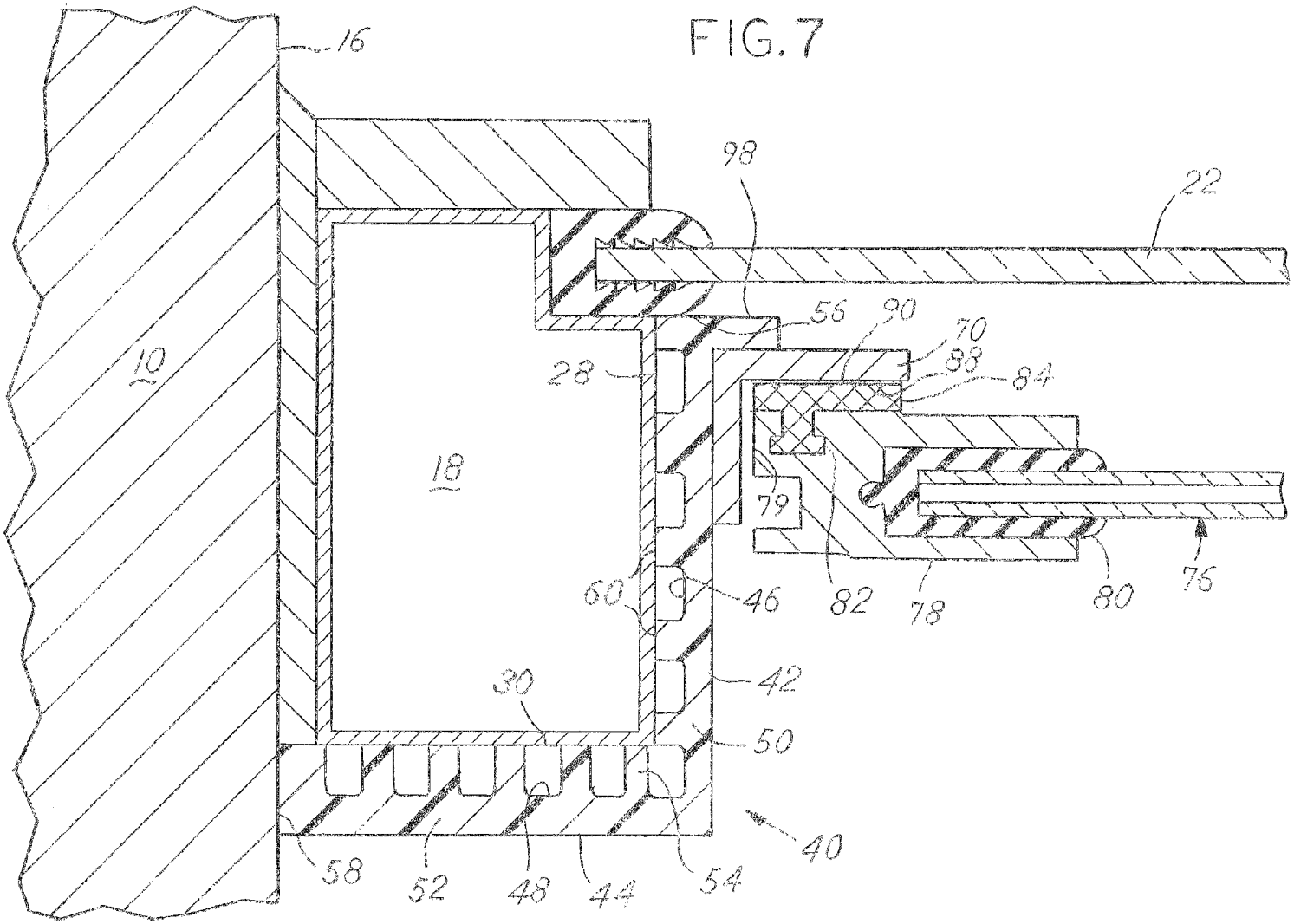
FIG. 7 is an alternate embodiment of the thermal break cap.

For assembly of the system, the thermal break 40 is trimmed or sized to fit over the existing frame 18. In order for the second portion 52 FIGS. 2, 3, 4, and 7 to properly mate to exposed surface 30, the first portion 50 must be sized the same or smaller than the length of exposed surface 28. In the event that the thermal break 40 is installed on the existing frame 18 that is adjacent to the building wall 10, the second portion 52 is sized to mate the terminal end 58 FIGS. 2 and 7 flush to the opening surface 16. The first portion 50 is sized to mate to either the existing gasket 32 FIGS. 1, 3, 4, and 6 or the inside facing surface 26 of the existing window pane 22. It is also possible to size the first portion 50 to have a gap between the terminal end 56 and the gasket 32 or inside surface 26 of the existing window. In the event that the thermal break 40 is installed on an intermediate part of the existing frame 18 (as shown in FIG. 3) the second portion 52 is sized to space opposing first portions 50 to snugly fit to exposed surfaces 28. The angle between the first portion 50 and the second portion 52 is preferentially slightly less than 90 degrees so that the mating surface 60 near terminal ends 56 and 58 are kept in biased contact with the exposed surfaces.

The system is built by taking a pane 76, sash 78, magnet 84 wool pile 86, and gasket 54 and assembling them into a window assembly. The magnets 84 are slid into the portions of the sash 78 that will be the sides of the panel. The wool pile 86 is slid into portions of the sash 78 that will be at the top and bottom. The gasket 54 circumscribes the perimeter of the pane 76 and the frame is cut to size. Corners are miter cut from the sash extrusion then mated, typically at a 45° angle, then a screw is installed through one side of the corner and into the slot 72 of the adjacent sash extrusion. Screws at each corner hold the sash extrusion parts together to form a continuous sash 78 that circumscribes the window pane 76. The cap 40 is either trimmed or sized before installation to mate properly with the inside facing surfaces 28, 30 of the existing frame 18. Next, the side rails 70, top channel 72, and bottom channel 74 are sized and overlay the exposed surface 42. The side rails 70, top channel 72, and bottom channel 74 are then secured to the existing frame 18 through rivets, screws 71, or other means. It is possible that the cap 40 is secured independently to the existing frame 18, and then the side rails 70, top channel 72, and bottom channel 74 are secured to the exposed surface 42. The window panel is then lifted into position where the sash 78 is first placed into the top channel 72, then the bottom channel 74. This puts the outside facing surface 88 of the magnet 84 into contact with the inside facing surface 90 of the exterior stop 70.

Optionally, the cap 40 contains a ledge that serves as an installation aid. The ledge forms a positive stop for the side rails 70, top channel 72, and bottom channel 74 to position them before they are secured. This ensures the system will be installed squarely and evenly spaced from the existing window and frame.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A thermal break system to be used with an existing window, said existing window having an existing window pane and an existing frame with inside facing surfaces extending inwardly from said window pane, said existing frame affixed to an opening in a wall, said thermal break system comprising:

a thermal break cap being an elongate member having lateral edges and a continuous wall therebetween, said continuous wall having an interior facing surface and an opposite frame facing surface, said frame facing surface having protrusions extending outward from said inner surface forming a planar surface offset from said frame facing surface, said continuous wall overlaying said inside facing surface of said existing frame, said thermal break cap being fixed to said existing frame;

an upper channel having a frame attachment portion and having parallel walls attached to said thermal break cap, said parallel walls extending substantially perpendicular from said attachment portion to form an upper groove adapted to receive a top of a thermal pane, said parallel walls having a lateral edge located oppositely of said frame attachment portion and being separated therefrom by a first distance, one of said parallel walls being interior facing, the other of said parallel walls being exterior facing, said upper channel fixed with respect to said existing frame and contacting said interior facing surface of said thermal break cap;

a lower channel having a frame attachment portion and having parallel walls attached to said thermal break cap, said parallel walls extending substantially perpendicular from said attachment portion to form a lower groove adapted to receive a bottom of said thermal pane, said parallel walls having a lateral edge located oppositely of said frame attachment portion and being separated therefrom by a second distance, one of said parallel walls being interior facing, the other of said parallel walls being exterior facing, said lower channel fixed with respect to said existing frame and contacting said interior facing surface of said thermal break cap, said first distance being larger than said second distance;

a stop spanning said upper and lower channels and having an interior facing surface formed from a material capable of magnetic attraction, said stop fixed with respect to said existing frame and directly contacting said interior facing surface of said thermal break cap; and said thermal pane including a sash circumscribing an insulative window pane, said sash having a top, a bottom, and sides, said sides including a material capable of magnetic attraction for securing to said interior facing surface of said stop, said sash being retained within said upper and lower channels, said top and bottom having a resilient material overlaying and directly contacting said exterior facing wall of said channels, said sides of said sash adapted for securing to said interior facing surface of said stop via magnetic attraction between said sash and said stop.

2. The thermal break system of claim 1, said stop having a lip portion and attachment portion, said exterior facing surface and interior facing surface being on said lip portion, a lateral edge of said sides of said thermal pane adapted to overlay said attachment portion.

3. The thermal break system of claim 2, said material capable of magnetic attraction on said sides of said sash being a permanent magnet, said resilient material being a wool pile.

4. The thermal break system of claim 3, one of said lateral edges of said thermal break cap abutting a portion of said existing window.

5. The thermal break system of claim 4, said protrusions on said thermal break cap forming separate cavities of trapped fluid when said planar surface overlays said inside facing surface of said existing frame.

6. The thermal break system of claim 1, said stop and said upper and lower channels affixed to said existing frame and said thermal break cap with fasteners.

7. The thermal break system of claim 1, said thermal break cap including a lip protruding outward from said exposed surface and adapted to abut said channels and said stop, said lip spaced from an adjacent lateral edge.

8. The thermal break system of claim 7, said protrusions on said thermal break cap forming separate cavities of trapped fluid when said planar surface overlays said inside facing surface of said existing frame.

9. The thermal break system of claim 8, and a fastener securing said stop and said channels through said thermal break cap to said existing frame.

10. A thermal break system to be used with an existing window, said existing window having an existing window pane and an existing frame with inside facing surfaces extending inwardly from said window pane, said existing frame affixed to an opening in a wall, said thermal break system comprising:

a thermal break cap being an elongate member having lateral edges and a continuous wall therebetween, said continuous wall having an interior facing surface and an opposite frame facing surface, said frame facing surface having protrusions extending outward from said inner surface forming a planar surface offset from said frame facing surface, said continuous wall adapted to overlay said inside facing surface of said existing frame, said thermal break cap being fixed to said existing frame;

an upper channel having a frame attachment portion and having parallel walls attached to said thermal break cap, said parallel walls extending substantially perpendicular from said attachment portion to form an upper groove adapted to receive a top of a thermal pane, one of said parallel walls being interior facing, the other of said parallel walls being exterior facing, said upper channel fixed with respect to said existing frame and contacting said interior facing surface of said thermal break cap;

a lower channel having a frame attachment portion and having parallel walls attached to said thermal break cap, said parallel walls extending substantially perpendicular from said attachment portion to form a lower groove adapted to receive a bottom of said thermal pane, one of said parallel walls being interior facing, the other of said parallel walls being exterior facing, said lower channel fixed with respect to said existing frame and contacting said interior facing surface of said thermal break cap, said upper channel having a larger depth than said lower channel;

a stop spanning said upper and lower channels and having an interior facing surface formed from a material capable of magnetic attraction, said stop fixed with respect to said existing frame and directly contacting said interior facing surface of said thermal break cap; and said thermal pane including a sash circumscribing an insulative window pane, said sash having a top, a bottom, and sides, said sides including a material capable of magnetic attraction for securing to said interior facing surface of said stop, said sash being retained within said upper and lower channels, said top and bottom having a resilient material overlaying and directly contacting said exterior facing wall of said channels, said sides of said sash adapted for securing to said interior facing surface of said stop via magnetic attraction between said sash and said stop.

11. The thermal break system of claim 10, said stop and said upper and lower channels affixed to said existing frame and said thermal break cap with fasteners.

12. The thermal break system of claim 11, said stop having a lip portion and attachment portion, said exterior facing surface and interior facing surface being on said lip portion, a lateral edge of said sides of said thermal pane adapted to overlay said attachment portion.

13. The thermal break system of claim 11, said material capable of magnetic attraction on said sides of said sash being a permanent magnet, said resilient material being a wool pile.

14. The thermal break system of claim 13, one of said lateral edges of said thermal break cap adapted to abut a portion of said existing window.

15. The thermal break system of claim 10, said protrusions on said thermal break cap forming separate cavities of trapped fluid when said planar surface overlays said inside facing surface of said existing frame.

16. The thermal break system of claim 15, said thermal break cap including a lip protruding outward from said exposed surface and adapted to abut said channels and said stop, said lip spaced from an adjacent lateral edge.

17. A thermal break system to be used with an existing window, said existing window having an existing window pane and an existing frame with inside facing surfaces, said existing frame affixed to an opening in a wall, said thermal break system comprising:

a thermal break cap being an elongate member having lateral edges and a continuous wall therebetween, said continuous wall having an interior facing surface and an opposite frame facing surface, said continuous wall overlaying said inside facing surface of said existing frame, said thermal break cap being fixed to said existing frame;

an upper channel having a frame attachment portion and having parallel walls attached to said thermal break cap, said parallel walls extending substantially perpendicular from said attachment portion to form an upper groove adapted to receive a top of a thermal pane, one of said parallel walls being interior facing, the other of said parallel walls being exterior facing, said upper channel fixed with respect to said existing frame and contacting said interior facing surface of said thermal break cap;

a lower channel having a frame attachment portion and having parallel walls attached to said thermal break cap, said parallel walls extending substantially perpendicular from said attachment portion to form a lower groove adapted to receive a bottom of said thermal pane, one of said parallel walls being interior facing, the other of said parallel walls being exterior facing, said lower channel fixed with respect to said existing frame and contacting said interior facing surface of said thermal break cap, said upper channel having a larger depth than said lower channel;

a stop spanning said upper and lower channels and having an interior facing surface formed from a material capable of magnetic attraction, said stop fixed with respect to said existing frame and directly contacting said interior facing surface of said thermal break cap; and said thermal pane including a sash circumscribing an insulative window pane, said sash having a top, a bottom, and sides, said sides including a material capable of magnetic attraction for securing to said interior facing surface of said stop, said sash being retained within said upper and lower channels, said top and bottom having a resilient material overlaying and directly contacting said exterior facing wall of said channels, said sides of said sash adapted for securing to said interior facing surface of said stop via magnetic attraction between said sash and said stop.

18. The thermal break system of claim 17, said frame facing surface of said thermal break cap having protrusions extending outward from said inner surface forming a planar surface offset from said frame facing surface.

19. The thermal break system of claim 18, said stop and said upper and lower channels affixed to said existing frame and said thermal break cap with fasteners.

20. The thermal break system of claim 17, said material capable of magnetic attraction on said sides of said sash being a permanent magnet, said resilient material being a wool pile.

* * * * *